US011229100B2

(12) United States Patent
Han

(10) Patent No.: US 11,229,100 B2
(45) Date of Patent: Jan. 18, 2022

(54) LIGHT SOURCE DRIVING DEVICE AND METHOD THEREFOR

(71) Applicant: LG INNOTEK CO., LTD., Seoul (KR)

(72) Inventor: Jae Hyun Han, Seoul (KR)

(73) Assignee: LG INNOTEK CO., LTD., Seoul (KR)

( * ) Notice: Subject to any disclaimer, the term of this patent is extended or adjusted under 35 U.S.C. 154(b) by 0 days.

(21) Appl. No.: 17/254,985

(22) PCT Filed: Jul. 5, 2019

(86) PCT No.: PCT/KR2019/008306
§ 371 (c)(1),
(2) Date: Dec. 22, 2020

(87) PCT Pub. No.: WO2020/009541
PCT Pub. Date: Jan. 9, 2020

(65) Prior Publication Data

US 2021/0267030 A1 Aug. 26, 2021

(30) Foreign Application Priority Data

Jul. 5, 2018 (KR) ..... 10-2018-0078182

(51) Int. Cl.
*H05B 45/14* (2020.01)
*H05B 45/325* (2020.01)
(Continued)

(52) U.S. Cl.
CPC ..... *H05B 45/14* (2020.01); *H05B 45/325* (2020.01); *H05B 45/375* (2020.01); *H05B 45/38* (2020.01)

(58) Field of Classification Search
CPC .... H05B 45/14; H05B 45/325; H05B 45/375; H05B 45/38
See application file for complete search history.

(56) References Cited

U.S. PATENT DOCUMENTS 8,247,993 B2 8/2012 Gong et al.
8,363,004 B2 1/2013 Ye et al.
(Continued)

FOREIGN PATENT DOCUMENTS

KR 10-0956222 5/2010
KR 10-2011-0012509 2/2011
(Continued)

OTHER PUBLICATIONS

International Search Report dated Oct. 17, 2019 issued in Application No. PCT/KR2019/008306.

*Primary Examiner* — Borna Alaeddini
(74) *Attorney, Agent, or Firm* — Ked & Associates, LLP

(57) ABSTRACT

A light source driving device may include a DC-DC conversion unit for generating an output voltage by adjusting a level of an input voltage, and a first light-emitting unit and a second light-emitting unit, which are driven by the output voltage of the DC-DC conversion unit. A regulator may be connected to the output end of the second light-emitting unit, and a controller may have a feedback terminal connected to the output ends of the first light-emitting unit and the second light-emitting unit. The regulator may operate such that a preset target current is supplied to the second light-emitting unit. The controller may adjust a duty of the pulse control signal based on the entire preset target current of the first light-emitting unit and the second light-emitting unit and the feedback current inputted through the feedback terminal.

10 Claims, 9 Drawing Sheets

(51) Int. Cl.
*H05B 45/38* (2020.01)
*H05B 45/375* (2020.01)

(56) References Cited

U.S. PATENT DOCUMENTS

| | | | | |
|---|---|---|---|---|
| 8,917,230 | B2 | 12/2014 | Shin et al. | |
| 9,560,710 | B2 * | 1/2017 | Beijer | H05B 45/395 |
| 9,986,608 | B2 * | 5/2018 | Raniero | H05B 45/10 |
| 2008/0143266 | A1 * | 6/2008 | Langer | H05B 45/50 315/185 R |
| 2008/0144236 | A1 | 6/2008 | Chiang et al. | |
| 2013/0057163 | A1 * | 3/2013 | Sutardja | H05B 45/20 315/185 R |
| 2013/0063035 | A1 * | 3/2013 | Baddela | H05B 45/3577 315/192 |
| 2013/0147355 | A1 | 6/2013 | Min et al. | |
| 2014/0211192 | A1 * | 7/2014 | Grootjans | G01C 3/08 356/5.01 |
| 2016/0183340 | A1 | 6/2016 | Lee et al. | |
| 2017/0006680 | A1 * | 1/2017 | Beijer | H05B 45/20 |

FOREIGN PATENT DOCUMENTS

| | | |
|---|---|---|
| KR | 10-1473366 | 12/2014 |
| KR | 10-1687358 | 12/2016 |
| KR | 10-1696749 | 1/2017 |
| KR | 10-1702387 | 2/2017 |

* cited by examiner

LIGHT SOURCE DRIVING DEVICE AND METHOD THEREFOR

CROSS-REFERENCE TO RELATED PATENT APPLICATIONS

This application is a U.S. National Stage Application under 35 U.S.C. § 371 of PCT Application No. PCT/KR2019/008306, filed Jul. 5, 2019, which claims priority to Korean Patent Application No. 10-2018-0078182, filed Jul. 5, 2018, whose entire disclosures are hereby incorporated by reference.

TECHNICAL FIELD

An embodiment relates to a light source driving device, more particularly, it to a light source driving device capable of stably driving multiple lighting channels using a single channel IC and a driving method thereof.

BACKGROUND ART

Light-emitting diodes (LEDs) are widely used as light sources. In particular, light emitting diodes are emerging as a promising market in the vehicle and lighting industry. Since light-emitting diodes can be used semi-permanently and realize high luminance and high power, they have been actively developed as light sources for vehicles in recent years.

In order to use a light emitting diode as a light source for a vehicle, the light emitting diode must emit light with a certain luminance. At this time, a constant current circuit designed in the form of an integrated circuit (IC) is provided in order for the light emitting diode to emit light with a constant luminance.

Meanwhile, a light-emitting diode used for a vehicle or for lighting is composed of a multi-channel structure in which arrays are connected in parallel with each other. Accordingly, an additional IC element must be provided for individual control of the multi-channel light-emitting diodes.

As described above, in order to individually control the multi-channel light emitting diode, there is a problem in that the number of channels and necessary components of the driving circuit increases, and thus the occupied area of the driving circuit increases, thereby complicating driving.

In addition, some IC that do not support multiple channels exist in a control circuit for constant current control of the LEDs, and there is a problem in that the single channel IC cannot stably drive the LEDs having multiple channels.

DISCLOSURE

Technical Problem

An embodiment according to the present invention is to provide a light source driving device and method capable of stably driving a multi-channel light emitting diode.

In addition, according to an embodiment of the present invention is to provide a light source driving device and method capable of stably driving a multi-channel light emitting diode by using a single channel control circuit.

In addition, according to another embodiment of the present invention is to provide, a light source driving device and a method capable to stably block the current flow while preventing the current pulling to a specific channel by using a single channel control circuit.

The technical problems to be achieved in the proposed embodiment are not limited to the technical problems mentioned above, and other technical problems not mentioned may be clearly understood by those of ordinary skill in the art to which the proposed embodiment belongs from the following description.

Technical Solution

In an embodiment, the light source driving device comprises: a DC-DC converter configured to generate an output voltage by adjusting a level of an input voltage according to a pulse control signal applied to a first switch element; a first light emitter and a second light emitter connected in parallel with each other and driven by the output voltage of the DC-DC converter and; a regulator connected to an output terminal of the second light emitter; and a controller having a feedback terminal connected to an output terminal of the first light emitter and the second light emitter, wherein the regulator is operated to supply a preset target current to the second light emitter, and the controller is configured to adjust a duty of the pulse control signal based on a preset total target current of the first light emitter and the second light emitter and a feedback current input through the feedback terminal, wherein a target current of the second light emitter is set by the regulator, and a target current of the first light emitter is set by the preset total target current.

In addition, the controller includes a feedback terminal of a single channel, and is commonly connected to the output terminals of the first and second light emitters through the feedback terminal of the single channel.

In addition, the light source driving device comprises a first resistor including one terminal connected to an output terminal of the DC-DC converter and other terminal connected to a cathode terminal of the regulator, and the first resistor is configured to limit a current input to the regulator.

In addition, the light source driving device comprises: a second switch element having a collector terminal connected to an output terminal of the first light emitter, a base terminal connected to an anode terminal of the regulator, and an emitter terminal connected to the feedback terminal of the controller.

In addition, the light source driving device comprises: a third switch element having a collector terminal connected to the output terminal of the second light emitter and a base terminal connected to a reference terminal of the regulator; and a second resistor having one terminal connected to an emitter terminal of the third switch element and the other terminal connected to the feedback terminal of the controller, wherein a resistance value of the second resistor is the target current of the second light emitter, and the regulator is configured to constantly maintain the output current of the second light emitter to correspond to the target current of the second light emitter regardless of a change in the output voltage of the DC-DC converter.

In addition, when the voltage is output through the DC-DC converter, the regulator is turned on by the voltage, and the third switch element is turned on as the regulator is turned on.

In addition, the light source driving device comprises: a third resistor having one terminal connected to an anode terminal of the regulator and the base terminal of the second switch element and other terminal connected to the feedback terminal of the controller, and a resistance value of the third resistor is set based on a threshold voltage for turning-on of the second switch element.

In addition, the cathode terminal and the reference terminal of the regulator are commonly connected to the base terminal of the third switch element and the other terminal of the first resistor, and the anode terminal of the regulator is connected to one terminal of the third resistor and the base terminal of the second switch.

In addition, when the second light emitter is short-circuited, the regulator is turned off, and a base voltage of the second switch element is lower than the threshold voltage as the regulator is turned off.

Meanwhile, a method of driving a light source according to an exemplary embodiment, in the method of driving a light source including multi-channel light emitters each of which is connected in parallel with each other and each having at least one light emitting element, determining a first light emitter having a priority among the multi-channel light emitter; determining a first target current of the determined first light emitter, determining a second target current of a second light emitter excluding the first light emitter and a target output current of a DC-DC converter based on the determined first target current of the first light emitter; supplying a current corresponding to the first target current to the first light emitter by operating a regulator as an output current corresponding to the target output current is output through the DC-DC converter; and supplying a current corresponding to the second target current excluding the first target current from the output current to the second light emitter, wherein output terminals of the first light emitter and the second light emitter are commonly connected to a single feedback terminal, wherein the supplying of the current corresponding to the first target current comprises supplying the current corresponding to the first target current to the first light emitter by the regulator regardless of a change in the output current, and wherein the current supplied to the second light emitter is blocked by turning off a switching element including a base terminal connected to an anode terminal of the regulator.

Advantageous Effects

In an embodiment according to the present invention, a multi-channel light emitter can be stably controlled using a single channel feedback terminal. That is, in an embodiment according to the present invention, a regulator is disposed at an output terminal of a light emitter having a priority among multi-channel light emitters. In addition, the regulator controls a current of the light emitter having the priority according to a current set in the light emitter having the priority. In addition, other light emitters other than the light emitter having the priority are controlled by a remaining current excluding the current of the light emitters of the priority from a total output current of the DC-DC converter. Accordingly, in the present invention, the current can be set for each of the multi-channel light emitters by using a single channel feedback terminal, and accordingly, the multi-channel light emitters can be stably driven. In addition, in the present invention, since the driver is configured with a single channel, the circuit configuration of the driver can be simplified, thereby reducing product cost.

Meanwhile, a driver for controlling conventional buck converter is a single-channel product that do not support multi-channel, and thus, it was impossible to configure a multi-channel light emitter. However, in the present invention, a multi-channel light emitter can be configured even in a product in which the driver of the buck converter supporting only a conventional single channel is installed.

In addition, in the present invention, when other light emitter other than the light emitter having the priority are opened, only the current set in the light emitter having the priority is supplied to the corresponding light emitter among a total output current of the DC-DC converter by the regulator. Accordingly, in the present invention, it is possible to improve a phenomenon in which the current is shifted to other light emitter as the specific light emitter is opened.

In addition, in the present invention, when the light emitter having the priority is opened, the operation of the regulator is stopped. Further, as the operation of the regulator is stopped, an operating voltage for turn-on is not supplied to a transistor disposed at an output terminal of the light emitter other than the priority, and accordingly, the transistor is turned off. In addition, the current supplied to the other light emitter is blocked by turning off the transistor. Accordingly, in the present invention, even when the light emitter of the priority is opened, the current supplied to the other light emitter can be stably blocked, thereby providing a highly reliable light source driving device.

BEST MODE

Figure 1:
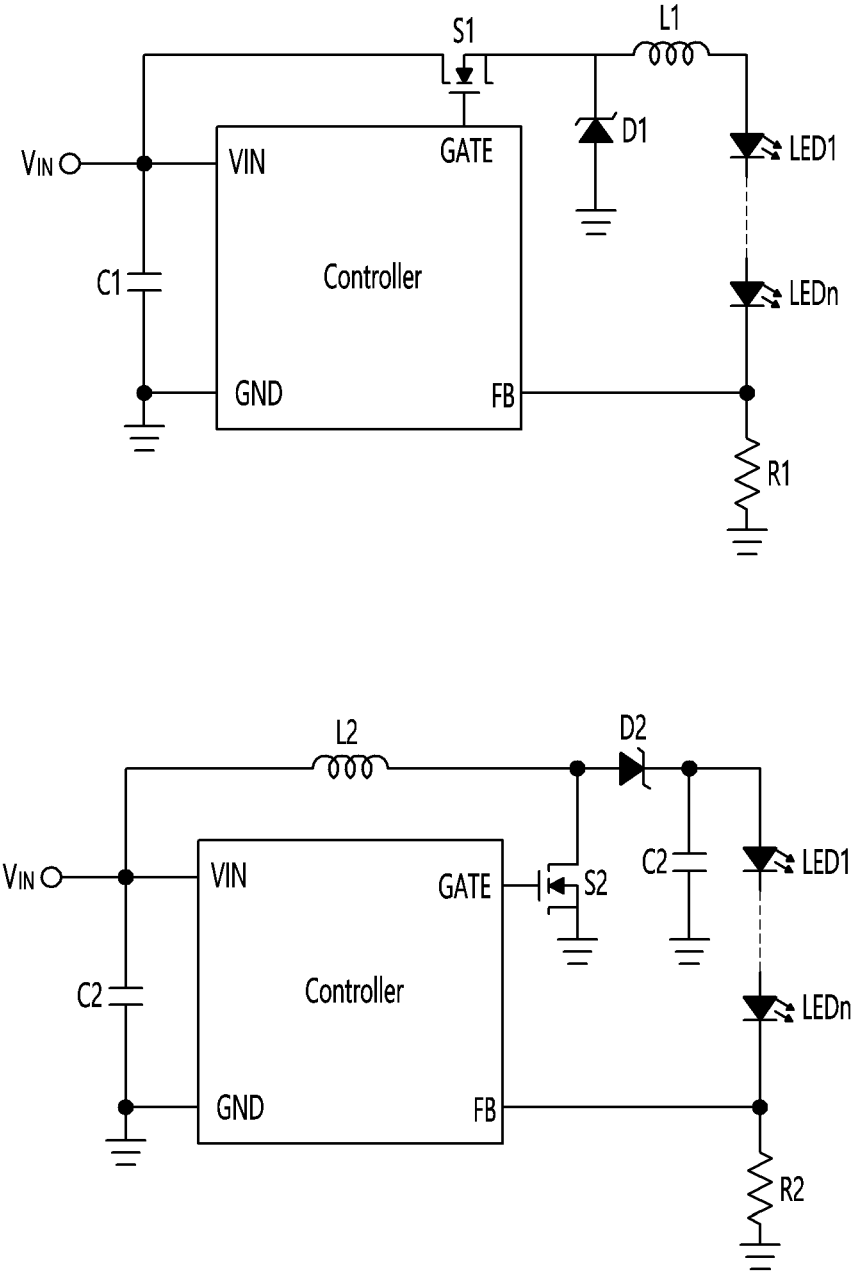
FIG. 1 is a diagram illustrating a light source driving device according to a comparative example.

Hereinafter, exemplary embodiments disclosed in the present specification will be described in detail with reference to the accompanying drawings, but identical or similar elements are denoted by the same reference numerals regardless of reference numerals, and redundant descriptions thereof will be omitted. The suffixes "module" and "part" for components used in the following description are given or used interchangeably in consideration of only the ease of preparation of the specification, and do not themselves have a distinct meaning or role. In addition, in describing the embodiments disclosed in the present specification, when it is determined that a detailed description of related known technologies may obscure the subject matter of the embodiments disclosed in the present specification, the detailed description thereof will be omitted. In addition, the accompanying drawings are for easy understanding of the embodiments disclosed in the present specification, and the technical idea disclosed in the present specification is not limited by the accompanying drawings, and all modifications included in the spirit and scope of the present invention It should be understood to include equivalents or substitutes.

Terms including an ordinal number such as first and second may be used to describe various elements, but the elements are not limited by the terms. These terms are used only for the purpose of distinguishing one component from another component.

When a component is referred to as being "connected" or "connected" to another component, it is understood that it may be directly connected or connected to the other component, but other components may exist in the middle. Should be. On the other hand, when a component is referred to as being "directly connected" or "directly connected" to another component, it should be understood that there is no other component in the middle.

Singular expressions include plural expressions unless the context clearly indicates otherwise.

In this application, terms such as "comprises" or "have" are intended to designate the presence of features, numbers, steps, actions, components, parts, or combinations thereof described in the specification, but one or more other features. It is to be understood that the presence or addition of elements or numbers, steps, actions, components, parts, or combinations thereof, does not preclude in advance the possibility.

FIG. 1 is a diagram illustrating a light source driving device according to a comparative example.

Referring to FIG. 1, the light source driving device according to the comparative example may be configured as a buck converter as in (a) and a boost converter as in (b) according to the level of the input power and output power.

The (a) shows an example of a buck converter, which can be applied when the input power is higher than the output power.

And the (b) shows an example of the boost converter, which can be applied when the input power is lower than the output power.

The buck converter includes a first switching element S1, a first inductor L1, and a first diode D1. In addition, the buck converter includes at least one light emitter (LED1 to LEDn) serving as a load, an input capacitor C1, and a controller.

The controller receives feedback from the output current of the light emitter, and controls the first switching device S1 according to a difference between the feedback current and a set current.

The boost converter comprises a second switching element (S2), a second inductor (L2), and a second diode (D2). The boost converter comprises at least one light emitter (LED1 to LEDn) serving as a load, an input capacitor (C2), and a controller.

The controller of the boost converter receives feedback from the output current of the light emitter and controls the second switching device S2 according to a difference between the feedback current and a set current.

As described above, in the comparative example, at least one light emitter constitutes a single-channel light emitter, and accordingly, the controller controls the output current of the converter based on the output current of the single channel light emitter.

However, in the comparative example as described above, when the light emitter is configured with multiple channels in parallel, a feedback circuit of the controller must also be configured with multiple channels, resulting in complicated circuit configuration.

In addition, in the comparative example, when a multi-channel light emitter is controlled by a single-channel controller, it is difficult to set a condition for switching control of the converter based on which light emitter among the multi-channel light emitters.

In addition, in the comparative example, when the multi-channel light emitter is controlled by a single-channel controller, when the light emitter of a specific channel is opened, a problem occurs in which the current is biased to the light emitter of another channel, which may lead to additional damage to the light emitter.

Figure 2:
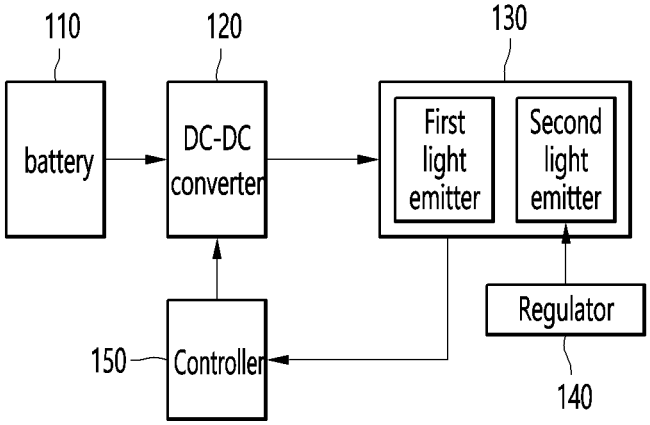
FIG. 2 is a block diagram showing the configuration of a light source driving device according to an embodiment of the present invention.

FIG. 2 is a block diagram showing the configuration of a light source driving device according to an embodiment of the present invention.

Referring to FIG. 2, a light source driving device according to an embodiment includes an input power supplier 110, a DC-DC converter 120, a light emitter 130, a regulator 140, and a controller 150.

The input power supplier 110 supplies input power for supplying power required to a load. The input power supplier 110 may be changed according to a product to which the light source driving device is applied. Preferably, the light source driving device may be applied to a vehicle, and the input power supplier 110 may be a battery provided in the vehicle.

The DC-DC converter 120 may receive input power Vbat from the input power supplier 110, and may change and output the level of the supplied input power Vbat based on a control signal.

The DC-DC converter 120 may obtain output power of a desired level through a designated processing process for the raw input power Vbat, and at this time, control is required to obtain the desired output power. In particular, control is essential in order to obtain a well-regulated output voltage even in situations in which the input voltage and the load current may change.

The type of the DC-DC converter 120 may be determined according to the level of the input power and the level of the output power.

That is, when the level of the input power is lower than the output power, the DC-DC converter 120 may be configured as a boost type. The boost type converter has a characteristic that the input power is lower than the output power. In other words, the boost type converter has a characteristic that the input voltage is lower than the output voltage.

In addition, when the level of the output power is lower than the input power, the DC-DC converter 120 may be configured as a buck type. The buck-type converter has a characteristic that the output power is lower than the input power. In other words, the buck-type converter has a characteristic that the output voltage is lower than the input voltage.

The light emitter 130 may receive an output current by power output from the DC-DC converter 120 and perform a light emitting operation by the output current. The light emitter 130 may include a plurality of light emitters connected in parallel with each other. For example, the light emitter 130 may include a first light emitter and a second light emitter connected in parallel with each other. In addition, each of the first and second light emitters may include at least one light emitting element. The light emitter 130 may include a semiconductor light emitting element such as a light emitting diode (LED), a light emitting element package or a light emitting device in which the semiconductor light emitting device is adopted, but is not limited thereto.

The light emitter 130 may constitute a vehicle brake lamp, a tail lamp, a backup lamp, or a turn signal lamp. That is, the light emitter 130 may have a configuration in which at least two light sources of a vehicle brake, tail light, reversing light, and direction indicator are connected in parallel to each other.

In addition, the number of light-emitting elements may vary according to a size or light output intensity required by a brake lamp, a tail lamp, a reversing lamp, or a turn signal lamp.

That is, any one of the light emitters of each channel constituting the light emitter 130 may include only one light emitting element, and the light emitter of the other channel may include at least two light emitting elements. Alternatively, all of the light emitters of each channel constituting the light emitter 130 may include only one light emitting element. In addition, differently, all of the light emitters of each channel constituting the light emitter 130 may include at least two or more light emitting elements.

The regulator 140 controls a current supplied to a specific light emitter having a priority among light emitters of a plurality of channels constituting the light emitter 130. Preferably, the regulator 140 supplies a preset current to a light emitter having a priority among light emitters of a plurality of channels constituting the light emitter 130.

That is, the DC-DC converter 120 outputs a voltage corresponding to the total current to be supplied to the light emitter 130. In addition, the regulator 140 allows a preset current to flow to the light emitter of the priority according to the voltage output from the DC-DC converter 120. In addition, a remaining current excluding the current supplied to the light emitter of the priority is supplied to the light emitter other than the light emitter of the priority.

Therefore, in the present invention, the output current of the DC-DC converter 120 is set based on a total current required by the light emitters of the plurality of channels, and a preset current is supplied to the light emitter having the priority among the plurality of light emitter by using the regulator.

The controller 150 receives the total output current of the light emitter 130 and controls the DC-DC converter 120 based on the received total output current and a preset current. Preferably, the DC-DC converter 120 includes a switching element, and the controller 150 is configured to adjust a duty of a signal supplied to the switching element to control the output current of the DC-DC converter 120 according to a feedback result.

That is, the controller 150 receives a feedback result of the total output current of the light emitter 130 through a feedback terminal of a single channel. In addition, the controller 150 controls the switching element based on a difference between a preset total output current of the light emitter 130 and the total output current received from the feedback result. Accordingly, the DC-DC converter 120 generates an output current adjusted based on the control of the controller 150.

At this time, a preset current always flows to a light emitter of a priority among the light emitters of the plurality of channels according to the control of the regulator 140, and a remaining current excluding the current supplied to the light emitter of the priority is supplied to the light emitter other than the light emitter of the priority. Accordingly, each of the light emitter of a plurality of channels can be controlled using single feedback terminal.

Meanwhile, in the present invention, in order to set the output current of the regulator 140, an output current of the light emitter having a priority among the plurality of light emitter may be set. In addition, in the present invention, the output current of the light emitter of a channel other than the light emitter of the priority may be set through the setting of the output current of the DC-DC converter 120. In other words, the output current of the light emitter of the other channel can be set by setting the total output current. That is, since the output current of the light emitter of the priority is already set through the regulator 140, the output current of the light emitter of the other channel can be adjusted by adjusting the total output current.

Hereinafter, the light source driving device of FIG. 2 will be described in more detail with reference to FIG. 3.

Figure 3:
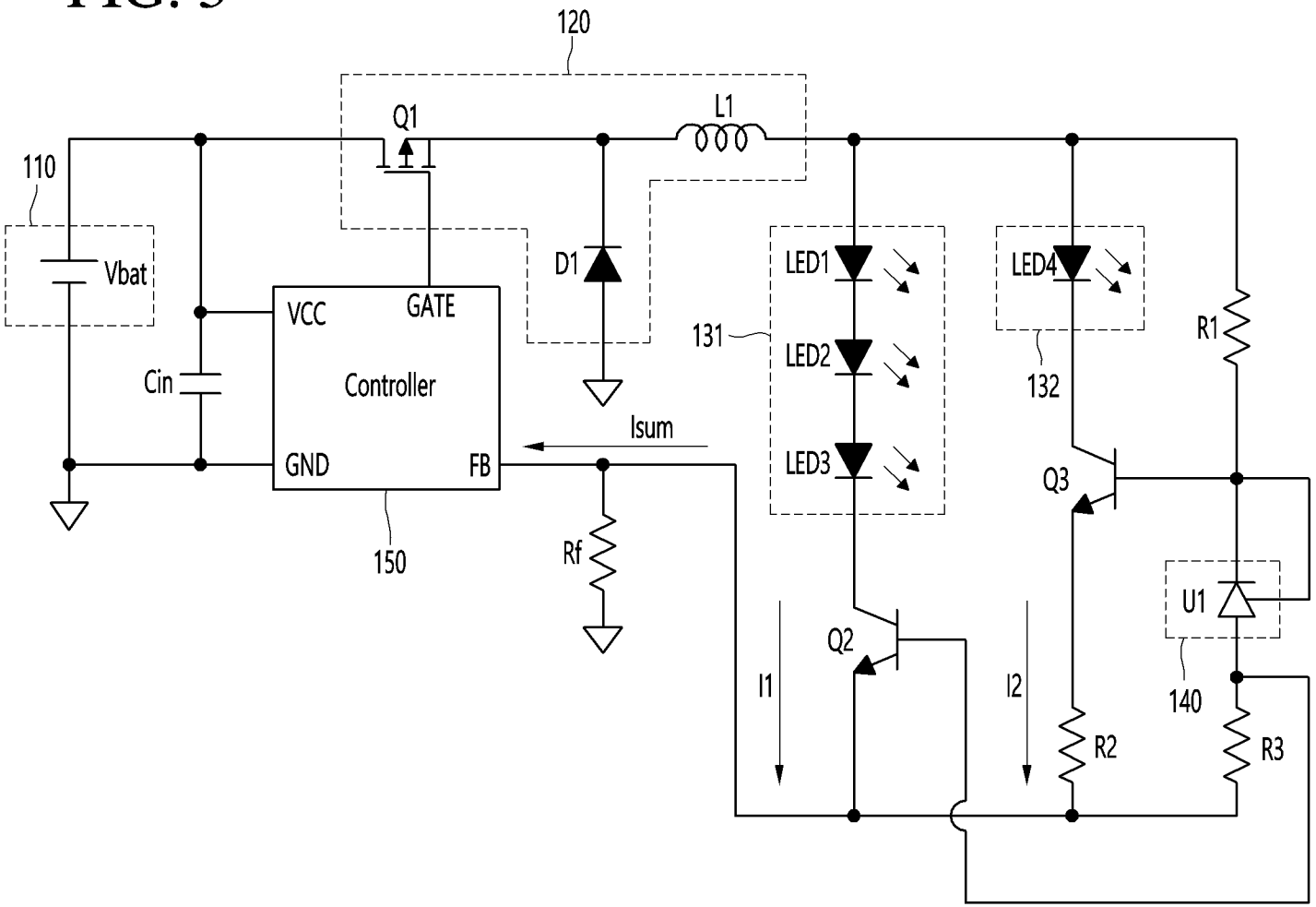
FIG. 3 is a detailed circuit diagram of the light source driving device of FIG. 2.

FIG. 3 is a detailed circuit diagram of the light source driving device of FIG. 2.

Referring to FIG. 3, the DC-DC converter 120 in the light source driving device includes a first switch element Q1, a first diode D1, and a first inductor L1. Further, the light emitter 130 includes a first light emitter 131 of a first channel and a second light emitter 132 of a second channel. The regulator 140 includes a power supply element U1. The power supply element U1 may be an AS 431 regulator.

In addition, the second switch element Q2 is disposed at an output end of the first light emitter 131, and the third switch element Q3 is disposed at an output end of the second light emitter 132.

In addition, a first resistor R1 and a third resistor R3 are disposed at both ends of the regulator 140, respectively.

In addition, a feedback resistor Rf is disposed at a feedback terminal of the controller 150.

In addition, an input capacitor Cin is disposed at an output terminal of the input power supplier 110.

Hereinafter, the connection relationship of each of the above configurations and functions thereof will be described.

The input power supplier 110 may be a battery that is disposed in a vehicle and supplies driving power to an electronic component of the vehicle.

The input capacitor Cin may be disposed at the output terminal of the input power supplier 110. One terminal of the input capacitor Cin may be connected to one terminal of the battery, and other terminal of the input capacitor Cin may be connected to other terminal of the battery.

In this case, the input capacitor Cin may be a smoothing capacitor. That is, the input capacitor Cin may function as a smoothing capacitor that charges DC power output from a battery constituting the input power supplier 110 and outputs a smoothing voltage.

The DC-DC converter 120 may include a first switch element Q1, a first diode D1, and a first inductor L1. Here, the DC-DC converter 120 may be a buck-type converter. That is, in the present invention, the voltage required by the light emitter 130 may be lower than the input voltage of the input power supplier 110. However, the present invention is not limited thereto, and the DC-DC converter 120 may be configured as a boost-type converter.

Meanwhile, in the case of the single-channel controller 150 that controls the DC-DC converter 120, a single feedback terminal is used, and the cost of the IC increases as the number of channels increases. In addition, the controller 150 for controlling the buck-type converter does not include an application supporting multiple channels, and accordingly, it is possible to control only the load of a single channel.

However, in the present invention, even a single-channel controller 150 that does not support the multiple channels can individually control a load composed of multiple channels. This can be achieved by the regulator 140, the second switch element Q2, the third switch element Q3, the first resistor R1, the second resistor R2, and the third resistor R3 described later.

Meanwhile, the first switch element Q1 of the DC-DC converter 120 may be a transistor. Preferably, the first switch element Q1 may be a Metal Oxide Semiconductor Field Effect Transistor (MOSFET). Preferably, the first switch element Q1 may be a P-channel MOSFET. However, the present invention is not limited thereto, and the first switch element Q1 may be formed of another type of transistor.

The first switch element Q1 may include a source terminal, a drain terminal, and a gate terminal.

The source terminal of the first switch element Q1 may be connected to one terminal of the input power supplier 110 and one terminal of the input capacitor Cin. In addition, the drain terminal of the first switch element Q1 may be connected to a cathode terminal of the first diode D1. In addition, the gate terminal of the first switch element Q1 may be connected to a gate terminal of the controller 150.

In addition, the cathode terminal of the first diode D1 may be connected to the drain terminal of the first switch element Q1 and one terminal of the first inductor L1. In addition, other terminal of the first inductor L1 may be connected to an input terminal of the light emitter 130.

The DC-DC converter 120 as described above operates by switching of the first switch element Q1. That is, when the first switch element Q1 of the DC-DC converter 120 is turned on, the power output from the input power supplier 110 is stored in the first inductor through the first switch element Q1. In addition, when the first switch element Q1 is changed to an turned off state, the power stored in the first inductor L1 is provided to the light emitter 130.

The first light emitter 131 and the second light emitter 132 are disposed at the output terminal of the DC-DC converter 120 and thus light emission operation is performed by the current output through the DC-DC converter 120.

In this case, in the drawing, it is shown that the first light emitter 131 includes three light emitting elements, and the second light emitter 132 includes one light emitting element. However, the present invention is not limited thereto, and the number of light-emitting elements constituting each light emitter may increase or decrease. That is, the second light emitter 132 may be formed of a plurality of light emitting elements instead of a single light emitting element. Also, the first light emitter 131 may be configured as a single light emitting element.

One terminal of the first resistor R1 is connected to the other terminal of the first inductor L1. In addition, the other terminal of the first resistor R1 is connected to an cathode terminal of the regulator 140 to be described later.

The regulator 140 includes an anode terminal, a cathode terminal, and a reference terminal. In addition, the cathode terminal of the regulator 140 is connected to the other terminal of the first resistor R1 and the base terminal of the third switch element Q3. Further, the reference terminal of the regulator 140 is connected to the base terminal of the third switch element Q3. In addition, the anode terminal of the regulator 140 is connected to one terminal of the third resistor R3.

The second switch element Q2 and the third switch element Q3 may be transistors. In addition, each of the second switch element Q2 and the third switch element Q3 may include a collector terminal, an emitter terminal, and a base terminal.

The collector terminal of the second switch element Q2 may be connected to the output terminal of the first light emitter 131. In addition, the base terminal of the second switch element Q2 may be connected to the anode terminal of the regulator 140. In addition, the emitter terminal of the second switch element Q2 may be connected to the feedback terminal of the controller 150.

The collector terminal of the third switch element Q3 may be connected to the output terminal of the second light emitter 132. In addition, the base terminal of the third switch element Q3 may be connected to the other terminal of the first resistor R1, the cathode terminal of the regulator 140, and a reference terminal of the regulator 140. In addition, the emitter terminal of the third switch element Q3 may be connected to one terminal of the second resistor R2.

One terminal of the second resistor R2 may be connected to the emitter terminal of the third switch element Q3 and the other terminal of the second resistor R2 may be connected to the feedback terminal of the controller 150.

One terminal of the third resistor R3 may be connected to the anode terminal of the regulator 140 and the base terminal of the second switch element Q2, and the other terminal of the third resistor R3 may be connected to the feedback terminal of the controller 150.

A feedback resistor Rf is connected to the feedback terminal of the controller 150 so that the total current of the light emitter 130 can be set.

In the present invention, a light emitter of two channels is included, and accordingly, the light emitter connected to the regulator 140 is controlled with priority, and the light emitter of the other channels is controlled thereafter.

In this case, the controller 150 controls the first switch element Q1 of the DC-DC converter 120 with a preset target current of the light emitter 130. In this case, the target current may be referred to as the total current of the light emitter 130. That is, the target current may be expressed as a sum of a first current required by the first light emitter 131 and a second current required by the second light emitter 132.

In addition, the regulator 140 in an embodiment of the present invention is connected to the output terminal of the second light emitter 132. In addition, the regulator 140 controls the current flowing through the second light emitter 132 based on the second current required by the second light emitter 132 of the second channel among the multi-channel light emitters.

In this case, the second current controlled by the regulator 140 may be set based on a size of the second resistor R2.

In general, the current of the regulator 140 is calculated as in Equation 1 below.

$$Q3\text{Vbe}+\text{ILED}*R2=\text{reference voltage}+Q2\text{Vbe} \quad \text{[Equation 1]}$$

Here, the Q3Vbe is a base-emitter voltage of the third switch element Q3.

The ILED refers to a target current of the second light emitter 132 connected to the regulator 140, and may be the second current as described above.

In addition, R2 means a resistance value of the second resistor R2.

Further, the reference voltage refers to a reference voltage of the regulator 140, and Q2Vbe refers to a base-emitter voltage of the second switch element Q2.

In this case, the reference voltage of the regulator 140 is generally 2.5V. In addition, a base-emitter voltage Vbe of a transistor is formed with a diode voltage equal to 0.7V.

Accordingly, if the base-emitter voltage of the second switch element Q2 and the base-emitter voltage of the third switch element Q3 are the same, the second current can be expressed as Equation 2 below.

$$\text{ILED}=2.5\text{V}/R2,\text{ILED}*R2=2.5\text{V} \quad \text{[Equation 2]}$$

Accordingly, in the present invention, the output current of the second light emitter R2 controlled by the regulator 140 may be controlled by adjusting the resistance value of the second resistor R2. For example, if the output current of the second light emitter R2, that is, the second current is set to 250 mA, the resistance value of the second resistor R2 may be set to 100. In addition, if it is desired to set the second current to 500 mA, the resistance value of the second resistor R2 may be set to 50.

As described above, in the present invention, the output current of the light emitter having priority among the light emitters of the multi-channel can be set by adjusting the resistance value of the second resistor R2.

In addition, the light emitters of channels other than the light emitters having the priority can be set through the output current of the DC-DC converter 120. In other words, the controller 150 controls the output current of the DC-DC converter 120 based on the preset target current.

In this case, the output current of the DC-DC converter 120 is a sum of a first current supplied to the first light emitter and a second current supplied to the second light emitter. In this case, the second current is set by adjusting the resistance value of the second resistor R2. In addition, the first current may be set through the setting of the output current of the DC-DC converter 120.

For example, if the output current of the second light emitter is set to 250 mA and the output current of the first light emitter is set to 300 mA, the resistance value of the second resistor R2 is set to 100, and the output current of the DC-DC converter 120 can be set to 550 mA.

And, when the output current of the DC-DC converter 120 (that is, the target current to be output from the DC-DC converter 120) is set to 550 mA, the controller 150 is adjusts the duty of a pulse width modulate (PWM) provided to the first switch element Q1 so that the target 550 mA is output through DC-DC converter 120. In addition, when 550 mA is output from the DC-DC converter 120 by the control of the first switch element Q1, the second light emitter 132 is preferentially controlled by the regulator 140. In addition, 250 mA of the set target current may be supplied to the second light emitter 132 by the regulator 140. In addition, among 550 mA output from the DC-DC converter 120, 300 mA other than 250 mA supplied to the second light emitter 132 may be supplied to the first light emitter 131.

In other words, the target current of the second light emitter 132 can be set by adjusting the resistance value of the second resistor R2. In addition, the target current of the first light emitter 131 can be set by the target current of the DC-DC converter 120.

Accordingly, in the present invention, even in the controller 150 provided with a single-channel feedback terminal, target currents of the multi-channel light emitter can be set, respectively. In addition, the light emitters of the multiple channels may be individually controlled through the set target current.

Meanwhile, the first resistor R1 is a limiter resistor for limiting a maximum current input to the regulator 140.

Further, the third resistor R3 may be formed to control the ground potential of the anode terminal of the regulator 140 to 2.5V. In addition, the third resistor R3 may be formed to set a threshold voltage for turning on the second switch element Q2.

In an embodiment according to the present invention as described above, a multi-channel light emitter can be stably controlled using a single channel feedback terminal. That is, in an embodiment according to the present invention, a regulator is disposed at an output terminal of a light emitter having a priority among multi-channel light emitters. In addition, the regulator controls a current of the light emitter having the priority according to a current set in the light emitter having the priority. In addition, other light emitters other than the light emitter having the priority are controlled by a remaining current excluding the current of the light emitters of the priority from a total output current of the DC-DC converter. Accordingly, in the present invention, the current can be set for each of the multi-channel light emitters by using a single channel feedback terminal, and accordingly, the multi-channel light emitters can be stably driven. In addition, in the present invention, since the driver is configured with a single channel, the circuit configuration of the driver can be simplified, thereby reducing product cost.

Meanwhile, a driver for controlling conventional buck converter is a single-channel product that do not support multi-channel, and thus, it was impossible to configure a multi-channel light emitter. However, in the present invention, a multi-channel light emitter can be configured even in a product in which the driver of the buck converter supporting only a conventional single channel is installed.

Figure 4:
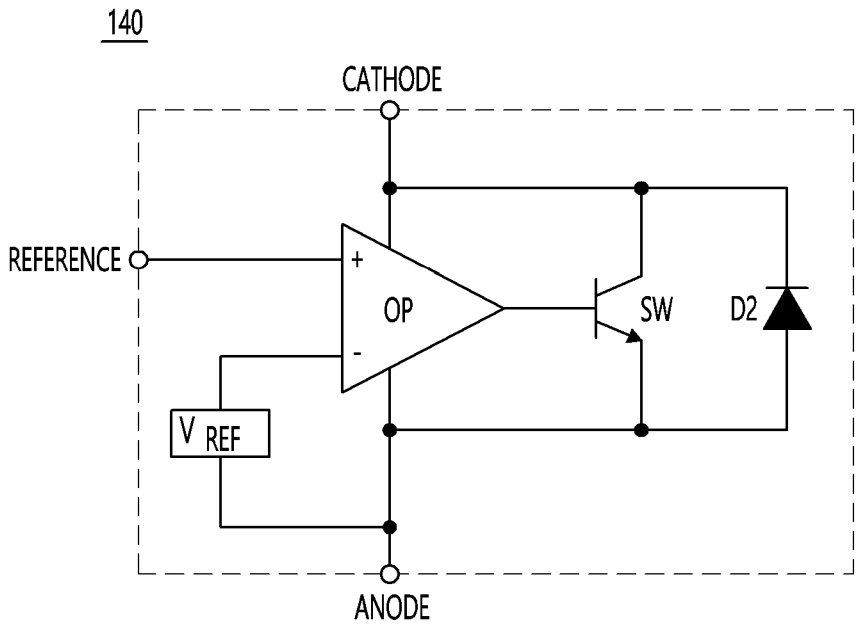
FIG. 4 is a detailed circuit diagram of the regulator illustrated in FIG. 3.

FIG. 4 is a detailed circuit diagram of the regulator illustrated in FIG. 3.

Hereinafter, a detailed circuit configuration and operation of the regulator 140 will be described. The regulator 140 may be composed of an AS431.

The AS431 is a regulator with guaranteed thermal stability over the entire operating range. The AS431 features rapid turn-on characteristics, low temperature coefficient and low output impedance, it can replace Zener diodes for applications such as switching power supplies, chargers and other adjustable regulators. The tolerance of AS431 is around 0.5%.

The regulator 140 includes an amplifier OP, a switch element SW, and a second diode D2.

In this case, the amplifier OP includes an inverting terminal (−) and a non-inverting terminal (+). In addition, the output voltage of the first resistor R1 connected to the reference terminal is input to the non-inverting terminal (+) of the amplifier OP.

In addition, a reference voltage signal VREF is input to an inverting terminal (−) of the amplifier OP. In this case, the reference voltage signal VREF may be 2.5V.

In this case, the output current of the DC-DC converter 120 is greater than the current required by the second light emitter 132. Accordingly, a voltage input to the non-inverting terminal (+) of the amplifier OP through the reference terminal may be different from the target voltage. Accordingly, the amplifier OP generates an output signal corresponding to a difference value between the voltage value input through the reference terminal and the reference voltage signal VREF.

Further, the switch element SW may be selectively conducted according to an output signal of the amplifier OP, so that a voltage corresponding to a preset target current may be supplied to the second light emitter 132.

To this end, the base terminal of the switch element SW is connected to the output terminal of the amplifier OP. In addition, the collector terminal of the switch element SW is connected to the non-inverting terminal (+) of the amplifier OP. In addition, the emitter terminal of the switch element SW is connected to the ground.

In addition, the anode terminal of the second diode D2 is connected to the collector terminal of the switch element SW, and the cathode terminal of the second diode D2 is connected to the ground with the emitter terminal of the switch element SW.

The operation of the regulator 140 configured as described above will be described below.

As described above, the cathode terminal of the regulator 140 is connected to the base terminal of the third switch element Q3 and the other terminal of the first resistor R1. In addition, the cathode terminal of the regulator 140 may be connected to the non-inverting terminal (+) of the amplifier OP2.

Accordingly, when the cathode voltage of the regulator 140 is lower than 2.5V corresponding to the reference voltage, the output of the amplifier OP becomes 0, and accordingly, a low signal is transmitted through the output terminal of the amplifier OP. At this time, when the low signal is output through the output terminal of the amplifier OP, the switch element SW connected to the amplifier OP is turned off. In addition, as the switch element SW is turned off, the cathode voltage increases.

At this time, when the cathode voltage of the regulator 140 increases to more than 2.5V, the output of the amplifier OP changes from a low signal to a high signal. At this time, as the high signal is output through the amplifier OP, the switch element SW is switched to the ON state. In addition, as the switch element SW is switched to the ON state, the switch element SW operates, and accordingly, the cathode voltage decreases.

As described above, the regulator 140 operates the amplifier OP and the switch element SW according to the cathode voltage, so that a constant output current is supplied to the second light emitter 132.

That is, the third switch element Q3 and the regulator 140 may be designed to be operated when the DC-DC converter 120 is operated. In this case, the battery voltage in the initial state is blocked by the first switch element Q1 of the DC-DC converter 120. In addition, power is supplied to the regulator 140 through the first resistor R1 disposed at the output terminal of the DC-DC converter 120 when the DC-DC converter 120 operates, and the third switch element Q3 is also turned on by the operation of the regulator 140. Accordingly, the target current set by the second resistor R2 can always flow through the second light emitter 132 regardless of the output current of the DC-DC converter 120.

Meanwhile, in the present invention, the multi-channel light emitters can be individually controlled through the single-channel feedback terminal as described above, and protection operation of the multi-channel light emitters is also performed.

Figure 5:
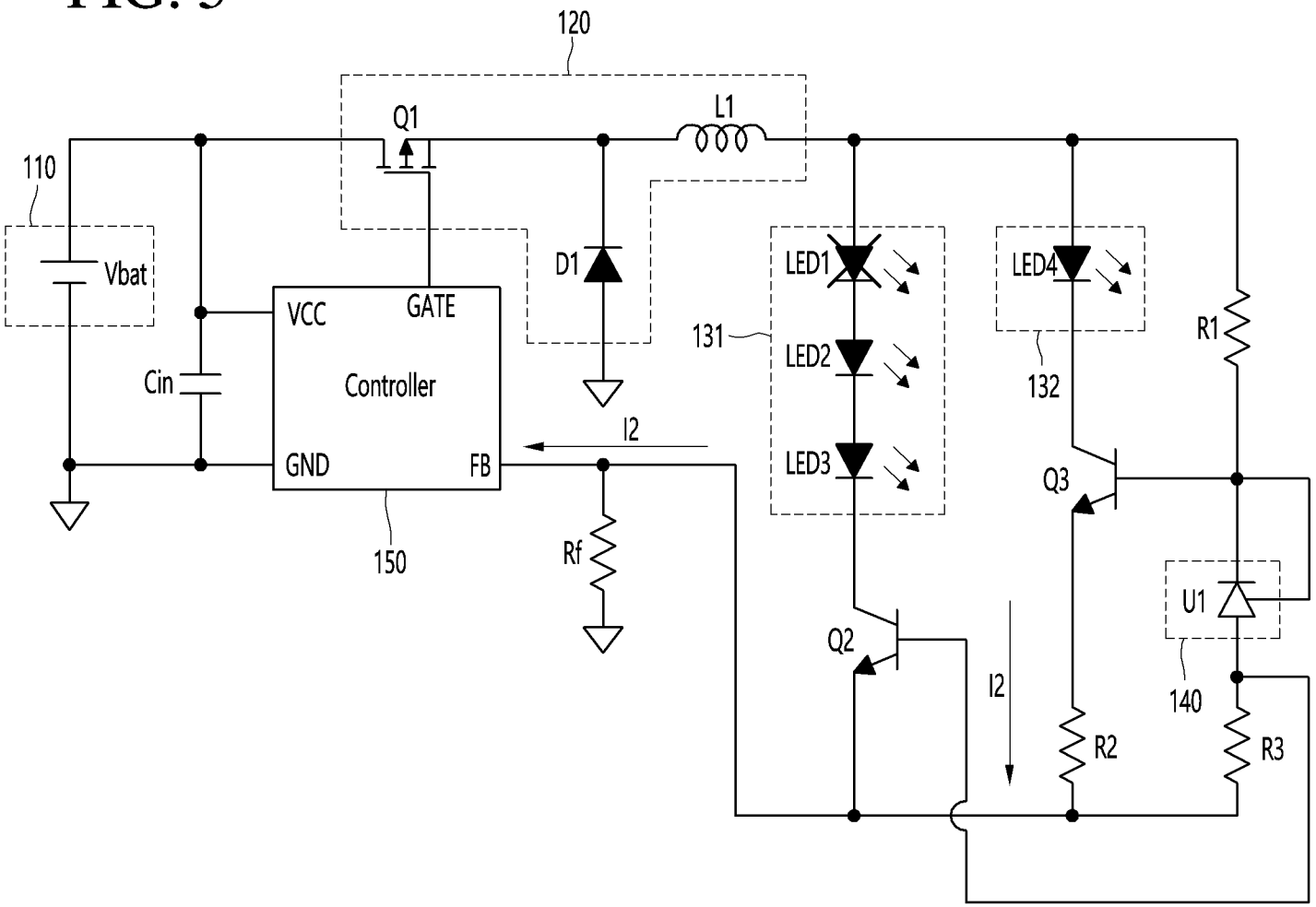
FIG. 5 is a diagram for explaining an operation when the first light emitter is opened in the present invention.

FIG. 5 is a diagram for explaining an operation when the first light emitter is opened in the present invention.

Referring to FIG. 5, the first light emitter 131 includes a plurality of light emitting elements. In this case, when at least one of the plurality of light emitting elements is damaged, the first light emitter 131 may not operate.

In this case, since the output current of the DC-DC converter 120 is not supplied to the first light emitter 131, all of the output current may be supplied to the second light emitter 132. Accordingly, in the conventional single-channel control product, there is a problem in that the second light emitter is also damaged in the above situation.

However, in the present invention, even when a specific light-emitting element among a plurality of light-emitting elements constituting the first light emitter 131 is opened, the target current can be constantly supplied to the second light emitter 132. have.

That is, when a specific light-emitting element among the plurality of light-emitting elements constituting the first light emitter 131 is opened, current does not conduct through a string constituting the first light emitter 131. At this time, current is conducted only to the second light emitter 132, and the set value of the regulator 140 has priority regardless of the setting of the controller 150, and thus the current of the second light emitter 132 is controlled by the regulator 140. That is, the regulator 140 applies a constant current to the second light emitter 132 according to the value set by the second resistor R2 regardless of the setting value of the controller 150, thereby preventing overcurrent. In this case, as the first light emitter 131 is opened, the remaining current flowing through the second light emitter 132 flows through the first resistor R1 and the regulator 140.

In addition, in the present invention, when other light emitter other than the light emitter having the priority are opened, only the current set to the light emitter having the priority among the total output current of the DC-DC converter is supplied to the corresponding light emitter by the regulator. Accordingly, in the present invention, it is possible to improve a phenomenon in which the current is shifted to other light emitter as the specific light emitter is opened.

Figure 6:
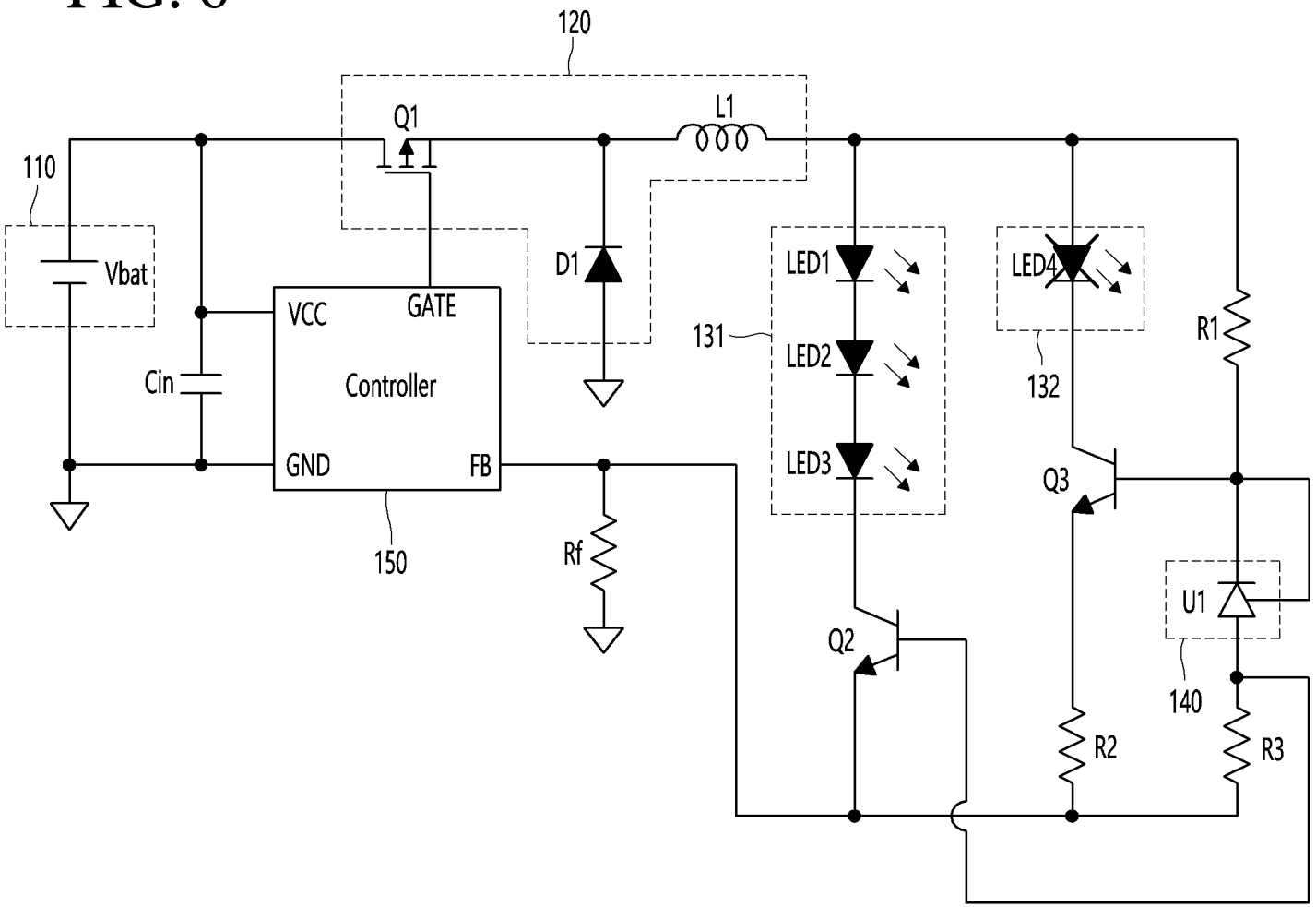
FIG. 6 is a diagram for explaining an operation when the second light emitter is opened in the present invention.

FIG. 6 is a diagram for explaining an operation when the second light emitter is opened in the present invention.

Referring to FIG. 6, in the present invention, a situation in which a light emitting element constituting the second light emitter having the priority is opened may occur. At this time, when the light emitting element constituting the second light emitter 132 is opened, current is not conducted through the second light emitter 132. Accordingly, the base voltage to the third switch element Q3 is lower than 2.5V, and thus the operation of the regulator 140 may be turned off. In this case, the base terminal of the second switch element Q2 is connected to the anode terminal of the regulator 140 and one terminal of the third resistor R1. At this time, as the operation of the regulator 140 is turned off, the voltage between the anode terminal of the regulator 140 and one terminal of the third resistor R1 becomes 0.7V or less. In addition, this has a value smaller than the threshold voltage for turning on the second switch element Q2. Accordingly, when the second light emitter 132 is open, the third switch element Q3 is turned off, and the regulator 140 is turned off, and the second switch element Q2 is also turned off in connection therewith. In addition, as the second switch element Q2 is turned off, the current flowing through the first light emitter 131 is blocked.

In addition, in the present invention, when the light emitter having the priority is opened, the operation of the regulator is stopped. Further, as the operation of the regulator is stopped, an operating voltage for turn-on is not supplied to a transistor disposed at an output terminal of the light emitter other than the priority, and accordingly, the transistor is turned off. In addition, the current supplied to the other light emitter is blocked by turning off the transistor. Accordingly, in the present invention, even when the light emitter of the priority is opened, the current supplied to the other light emitter can be stably blocked, thereby providing a highly reliable light source driving device.

Figure 7:
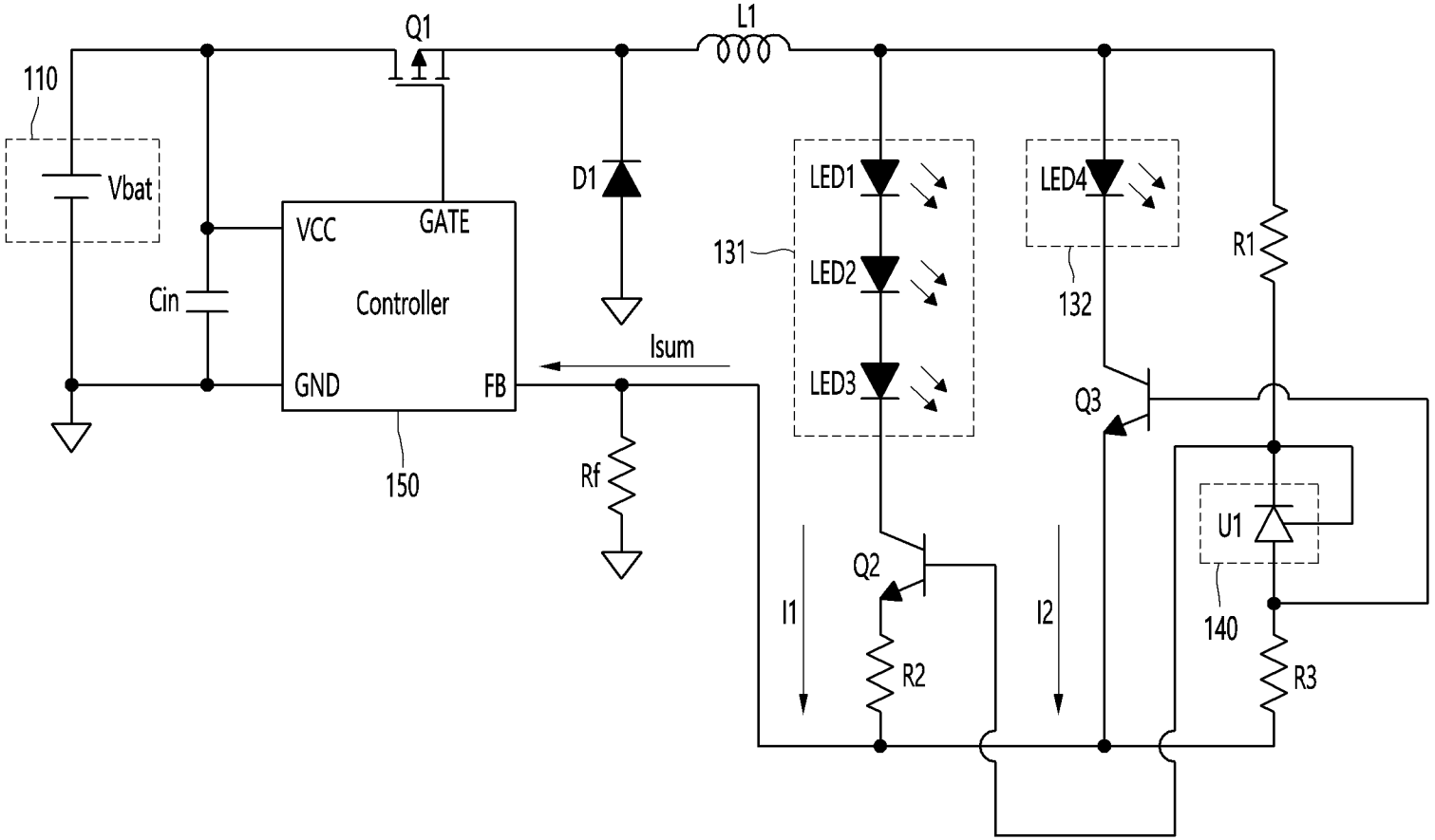
FIG. 7 is a circuit diagram illustrating a modified example of the light source driving device of FIG. 3.

FIG. 7 is a circuit diagram illustrating a modified example of the light source driving device of FIG. 3.

In the above description, it has been described as an example that the light emitter having priority is the second light emitter 132.

In addition, the circuit may be configured so that the first light emitter 131 other than the second light emitter 132 has priority.

In this case, referring to FIG. 7, the connection position of the regulator 140 is different, and the position of the second resistor R2 is different.

That is, in FIG. 3, the second resistor R2 is connected to the emitter terminal of the third switch element Q3 which is the output terminal of the second light emitter 132.

However, referring to FIG. 7, the second resistor R2 may be connected between the emitter terminal of the first switch element Q1 and the feedback terminal.

In addition, the cathode terminal of the regulator 140 is connected to the other terminal of the first resistor R1 and the base terminal of the second switch element Q2. In addition, the reference terminal of the regulator 140 is connected to the base terminal of the second switch element Q2. In addition, the anode terminal of the regulator 140 may be connected to one terminal of the third resistor R3 and the base terminal of the third switch element Q3.

As described above, in the present invention, by changing the connection configuration of the regulator 140 or the position of the second resistor, the light emitter to be controlled with priority among the multi-channel light emitters may be determined.

Figure 8:
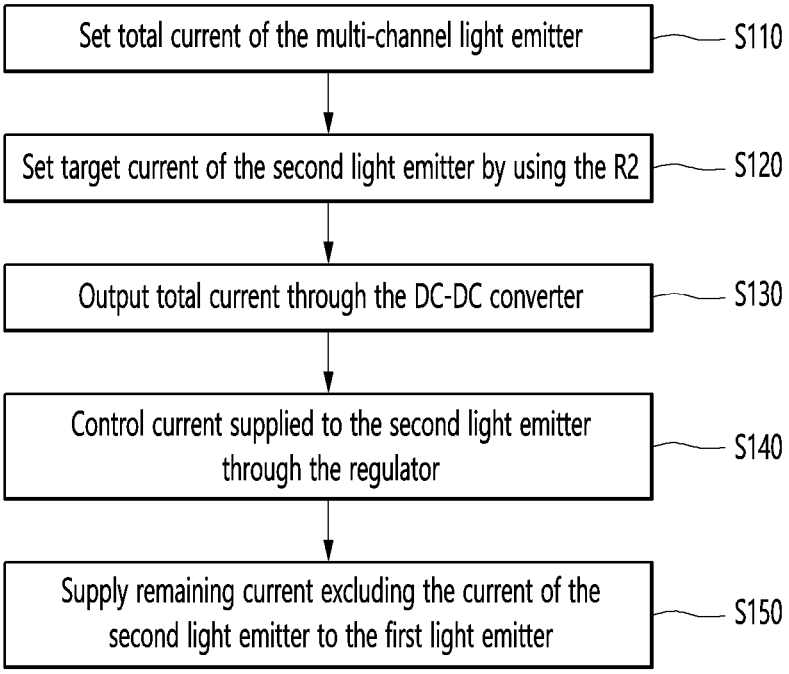
FIGS. 8 and 9 are flowcharts for explaining step-by-step a method of a light source driving device according to an embodiment of the present invention.
Figure 9:
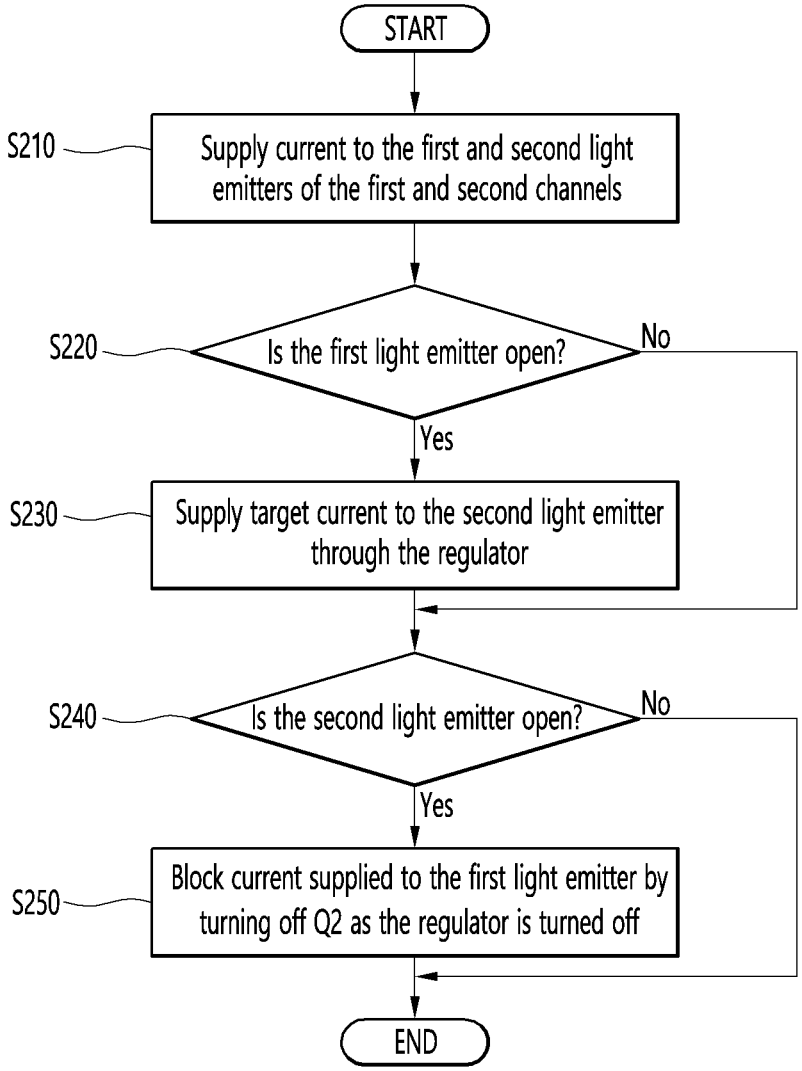

FIGS. 8 and 9 are flowcharts illustrating a step-by-step method of a light source driving device according to an exemplary embodiment of the present invention.

Referring to FIG. 8, the controller 150 sets a target current corresponding to the total current to be provided to the multi-channel light emitter (step 110).

In addition, the controller 150 sets a target current of the second light emitter 132 having a priority among the multi-channel light emitters by using the resistance value of the second resistor R2 (step 120).

In this case, the target current corresponding to the total current may be determined by the target current of the second light emitter 132 and the target current of the first light emitter 131, and the sum of target currents individually required by each light emitter may be set as the target current corresponding to the total current.

Subsequently, the controller 150 controls the duty of a signal supplied to the first switch element Q1 of the DC-DC converter 120 based on a target current corresponding to the total current, and controls the output current of the DC-DC converter 120 (step 130).

At this time, the regulator 140 operates when a current is output from the DC-DC converter 120, and e regulator 140 controls the output current of the second light emitter according to the target current set in the second light emitter (step 140).

Thereafter, current remaining except for the output current of the second light emitter controlled by the regulator 140 is supplied to the first light emitter. (step 150).

In addition, referring to FIG. 9, current is supplied to the first and second light emitters of the first and second channels, respectively, as described above (step 210).

At this time, when the opening of the first light emitter occurs (step 220), the output current of the second light emitter is controlled according to the target current through the regulator 140, regardless of the opening of the first light emitter (step 230).

In addition, when the second light emitter 132 is opened, the operation of the third switch device Q3 and the regulator 140 is turned off according to the opening of the second light emitter, and thus the second switch is turned off. Accordingly, the current supplied to the first light emitter 131 is blocked.

In an embodiment according to the present invention, a multi-channel light emitter can be stably controlled using a single channel feedback terminal. That is, in an embodiment according to the present invention, a regulator is disposed at an output terminal of a light emitter having a priority among multi-channel light emitters. In addition, the regulator controls a current of the light emitter having the priority according to a current set in the light emitter having the priority. In addition, other light emitters other than the light emitter having the priority are controlled by a remaining current excluding the current of the light emitters of the priority from a total output current of the DC-DC converter. Accordingly, in the present invention, the current can be set for each of the multi-channel light emitters by using a single channel feedback terminal, and accordingly, the multi-channel light emitters can be stably driven. In addition, in the present invention, since the driver is configured with a single channel, the circuit configuration of the driver can be simplified, thereby reducing product cost.

Meanwhile, a driver for controlling conventional buck converter is a single-channel product that do not support multi-channel, and thus, it was impossible to configure a multi-channel light emitter. However, in the present invention, a multi-channel light emitter can be configured even in a product in which the driver of the buck converter supporting only a conventional single channel is installed.

In addition, in the present invention, when other light emitter other than the light emitter having the priority are opened, only the current set in the light emitter having the priority is supplied to the corresponding light emitter among a total output current of the DC-DC converter by the regulator. Accordingly, in the present invention, it is possible to improve a phenomenon in which the current is shifted to other light emitter as the specific light emitter is opened.

In addition, in the present invention, when the light emitter having the priority is opened, the operation of the regulator is stopped. Further, as the operation of the regulator is stopped, an operating voltage for turn-on is not supplied to a transistor disposed at an output terminal of the light emitter other than the priority, and accordingly, the transistor is turned off. In addition, the current supplied to the other light emitter is blocked by turning off the transistor. Accordingly, in the present invention, even when the light emitter of the priority is opened, the current supplied to the other light emitter can be stably blocked, thereby providing a highly reliable light source driving device.

The invention claimed is:

1. A light source driving device comprising:

a DC-DC converter configured to generate an output voltage by adjusting a level of an input voltage according to a pulse control signal applied to a first switch element;

a first light emitter and a second light emitter connected in parallel with each other and driven by the output voltage of the DC-DC converter and;

a regulator connected to an output terminal of the second light emitter; and a controller having a feedback terminal connected to an output terminal of the first light emitter and the second light emitter, wherein the regulator is operated to supply a target current to the second light emitter, wherein the controller is configured to adjust a duty of the pulse control signal based on a preset total target current of the first light emitter and the second light emitter and a feedback current input through the feedback terminal, wherein the preset target current of the second light emitter is set by the regulator, and wherein a target current of the first light emitter is set by the preset total target current.

2. The light source driving device of claim 1, wherein the controller includes the feedback terminal of a single channel, and is commonly connected to the output terminals of the first and second light emitters through the feedback terminal of the single channel.

3. The light source driving device of claim 1, further comprising:

a first resistor having one terminal connected to an output terminal of the DC-DC converter and other terminal connected to a cathode terminal of the regulator, and wherein the first resistor is configured to limit a current input to the regulator.

4. The light source driving device of claim 3, further comprising:

a second switch element having a collector terminal connected to an output terminal of the first light emitter, a base terminal connected to an anode terminal of the regulator, and an emitter terminal connected to the feedback terminal of the controller.

5. The light source driving device of claim 4, further comprising:

a third switch element having a collector terminal connected to the output terminal of the second light emitter and a base terminal connected to a reference terminal of the regulator; and a second resistor having one terminal connected to an emitter terminal of the third switch element and the other terminal connected to the feedback terminal of the controller, wherein a resistance value of the second resistor is the target current of the second light emitter, and wherein the regulator is configured to constantly maintain the output current of the second light emitter to correspond to the target current of the second light emitter regardless of a change in the output voltage of the DC-DC converter.

6. The light source driving device of claim 5, wherein when the output voltage is output through the DC-DC converter, the regulator is turned on by the output voltage, and the third switch element is turned on as the regulator is turned on.

7. The light source driving device of claim 5, further comprising:

a third resistor having one terminal connected to an anode terminal of the regulator and the base terminal of the second switch element and other terminal connected to the feedback terminal of the controller, and wherein a resistance value of the third resistor is set based on a threshold voltage for turning-on of the second switch element.

8. The light source driving device of claim 7, wherein the cathode terminal and the reference terminal of the regulator are commonly connected to the base terminal of the third switch element and the other terminal of the first resistor, and Wherein the anode terminal of the regulator is connected to one terminal of the third resistor and the base terminal of the second switch.

9. The light source driving device of claim 6, wherein when the second light emitter is short-circuited, the regulator is turned off, and wherein a base voltage of the second switch element is lower than the threshold voltage as the regulator is turned off.

10. A method of driving of a light source driving device including multi-channel light emitters each of which is connected in parallel with each other and each having at least one light emitting element, the method comprising:

determining a first light emitter having a priority among the multi-channel light emitter;

determining a first target current of the determined first light emitter;

determining a second target current of a second light emitter excluding the first light emitter and a target output current of a DC-DC converter based on the determined first target current of the first light emitter;

supplying a current corresponding to the first target current to the first light emitter by operating a regulator as an output current corresponding to the target output current is output through the DC-DC converter; and supplying a current corresponding to the second target current excluding the first target current from the output current to the second light emitter, wherein output terminals of the first light emitter and the second light emitter are commonly connected to a single feedback terminal, wherein the supplying of the current corresponding to the first target current comprises supplying the current corresponding to the first target current to the first light emitter by the regulator regardless of a change in the output current, and wherein the current supplied to the second light emitter is blocked by turning off a switching element including a base terminal connected to an anode terminal of the regulator.

* * * * *